US009492859B2

(12) United States Patent
Martin Gonzalez et al.

(10) Patent No.: US 9,492,859 B2
(45) Date of Patent: Nov. 15, 2016

(54) PRESS SYSTEMS AND METHODS

(71) Applicant: AUTOTECH ENGINEERING A.I.E., Amorebieta-Etxano (ES)

(72) Inventors: Ignacio Martin Gonzalez, Sant Pere De Ribes (ES); Manuel López Lage, Abrera (ES); Pedro Raya Zamora, Sant Quirze Del Valles (ES); Anna Sunden, Södra Sunderbyn (SE); Daniel Berglund, Norrf Järden (SE); Kenneth Isaksson, Boden (SE); Sören Isaksson, Södra Sunderbyn (SE)

(73) Assignee: AUTOTECH ENGINEERING A.I.E., Amorebieta-Etaxano (ES)

( * ) Notice: Subject to any disclaimer, the term of this patent is extended or adjusted under 35 U.S.C. 154(b) by 0 days.

(21) Appl. No.: 15/011,235

(22) Filed: Jan. 29, 2016

(65) Prior Publication Data

US 2016/0263640 A1 Sep. 15, 2016

(30) Foreign Application Priority Data

Mar. 9, 2015 (EP) ..... 15382103

(51) Int. Cl.
*B21D 22/02* (2006.01)
*B21D 37/16* (2006.01)
(Continued)

(52) U.S. Cl.
CPC ..... *B21D 37/16* (2013.01); *B21D 22/02* (2013.01); *B21D 22/022* (2013.01); *B21D 26/02* (2013.01); *B21D 35/001* (2013.01); *C21D 1/18* (2013.01); *C21D 1/673* (2013.01)

(58) Field of Classification Search
CPC .... B21D 22/02; B21D 22/022; B21D 26/02; B21D 35/001; B21D 37/16; C21D 1/18; C21D 1/673
USPC ..... 72/326, 342.2, 342.5, 348, 353.2, 72/354.2, 356, 357, 360, 361, 384, 405.01
See application file for complete search history.

(56) References Cited

U.S. PATENT DOCUMENTS 9,321,092 B2 * 4/2016 Takasue ..... B21D 22/02
2010/0095733 A1 4/2010 Salamon et al.
(Continued)

FOREIGN PATENT DOCUMENTS

DE 10 2008 039264 A1 3/2010
DE 10 2009 012940 A1 9/2010
(Continued)

OTHER PUBLICATIONS

European Search Report mailed on Sep. 1, 2015, for European Patent Application No. 15 38 2103, 4 pp.

*Primary Examiner* — David B Jones
(74) *Attorney, Agent, or Firm* — Squire Patton Boggs (US) LLP

(57) ABSTRACT

Press systems for manufacturing hot formed structural components are provided. The systems comprise a fixed lower body, a mobile upper body and a mechanism configured to provide upwards and downwards press progression of the mobile upper body with respect to the fixed lower body. The system further includes a cooling tool configured to cool down a previously heated blank. The cooling tool includes upper and lower mating dies, the lower die connected to the lower body with one or more lower biasing elements and/or the upper die connected to the upper body with one or more upper biasing elements. The system further includes a press tool configured to draw the blank, wherein the press tool is arranged downstream from the cooling tool. Moreover, methods for hot forming structural components are also provided.

20 Claims, 7 Drawing Sheets

(51) Int. Cl.

| | |
|---|---|
| ***B21D 35/00*** | (2006.01) |
| ***C21D 1/18*** | (2006.01) |
| ***C21D 1/673*** | (2006.01) |
| ***B21D 26/02*** | (2011.01) |

(56) References Cited

U.S. PATENT DOCUMENTS

2013/0111966 A1* 5/2013 Takasue ..... B21D 22/022 72/360
2013/0312474 A1* 11/2013 Dykstra ..... B21D 26/02 72/60
2014/0338802 A1 11/2014 Okita et al.

FOREIGN PATENT DOCUMENTS

| | | |
|---|---|---|
| EP | 2 324 938 A1 | 5/2011 |
| JP | H06344200 | 12/1994 |
| JP | 2007/136533 | 6/2007 |
| JP | 2007/144495 | 6/2007 |
| KR | 2011/0075732 | 7/2011 |
| WO | WO 2011/115539 A1 | 9/2011 |

* cited by examiner

PRESS SYSTEMS AND METHODS

This application claims priority to European Patent Application No. 15382103.8, filed Mar. 9, 2015, the entire contents of which are hereby incorporated by reference.

The present disclosure relates to press systems for manufacturing hot formed structural components and methods therefor.

BACKGROUND

In the field of vehicle construction, the development and implementation of lightweight materials or components is becoming more and more important in order to satisfy criteria for lightweight construction. The demand for weight reduction is especially driven by the goal of reduction of CO2 emissions. The growing concern for occupant safety also leads to the adoption of materials which improve the integrity of the vehicle during a crash while also improving the energy absorption.

A process known as Hot Forming Die Quenching (HFDQ) (also known as hot stamping or press hardening) uses boron steel sheets to create stamped components with Ultra High Strength Steel (UHSS) properties, with tensile strengths of e.g. 1.500 MPa or even up to 2000 MPa or more. The increase in strength as compared to other material allows for a thinner gauge material to be used, which results in weight savings over conventionally cold stamped mild steel components.

The steel sheets may be coated or uncoated. However, in order to improve corrosion protection, before, during or after a hot stamping process, coatings may be applied. For example the use of Al—Si coatings or Zn coatings is known.

Depending on the composition of the base steel material, blanks may need to be quenched (i.e. be cooled down rapidly) to achieve the high tensile strengths. Also examples of steel material which can harden at room temperature by air cooling with relatively low cooling speed are known.

The hot stamping process may be performed in a manner such that a blank to be hot formed is heated to a predetermined temperature e.g. austenization temperature by, for example, a furnace system so as to decrease the strength i.e. to facilitate the hot stamping process. The blank to be hot formed may be formed by, for example, a press system having a low temperature compared to the blank (e.g. room temperature) and a temperature control, thus a shaping process and a heat treatment using the temperature difference may be performed.

The use of multistep press systems for manufacturing hot formed elements is known. The multistep press systems may comprise a plurality of tools configured to perform different operations on blanks simultaneously. With such arrangements, a plurality of blanks undergo different manufacturing steps simultaneously during each stroke using the tools forming the multistep press systems, thus the performance of the system may be increased.

A multistep press system may include a conveyor or a transferring device which transfers the heated blank to a press tool which is configured to press the blank. Additionally, a furnace system that heats and softens the blank to be hot formed may be provided upstream from the multistep press system or apparatus. Furthermore, a separate laser process step or a separate cutting tool may also be provided, wherein the stamped blanks are discharged from the press system and are transferred and located into the laser process step or in the separate cutting tool in order to be manufactured e.g. cut and/or trimmed and/or pierced and/or punched.

Generally, in such systems, an external pre-cooling tool is used in order to previously cool down the blank to be hot formed. For example, zinc coated steel blanks need to be cooled down before a hot forming process to reduce or minimize problems such as microcracks. Once the blank is cooled down, it is transferred from the external pre-cooling tool to the multistep press apparatus or system.

The present disclosure seeks to provide improvements in multistep processes and systems.

SUMMARY

In a first aspect, a press system for manufacturing hot formed structural components is provided. The system comprises a fixed lower body, a mobile upper body and a mechanism configured to provide an upwards and downwards press progression of the mobile upper body with respect to the fixed lower body. The system further comprises a cooling tool configured to cool down a previously heated blank, the cooling tool comprising: upper and lower mating cooling dies, each cooling die comprising one or more working surfaces that in use face the blank, and the lower cooling die is connected to the lower body with one or more lower biasing elements configured to bias the lower die towards a position at a predetermined first distance from the lower body and/or the upper cooling die is connected to the upper body with one or more upper biasing elements configured to bias the upper die towards a position at a predetermined second distance from the upper body. The system further comprises a press tool configured to draw the blank, wherein the press tool is arranged downstream from the cooling tool and comprises: upper and lower mating pressing dies, each pressing die comprising one or more working surfaces that in use face the blank, and the upper pressing die is fastened to the upper body and the lower die pressing die is fastened to the lower body, and a blank transfer mechanism to transfer the blank from the cooling tool to the press tool.

According to this aspect, a press system is provided combining a cooling tool and a drawing/pressing tool.

In order to speed up the manufacturing process, the pressing and cooling tools are integrated in the same apparatus, but this implies that the cooling stroke has to be synchronized with the pressing/drawing or forming stroke. In order to ensure that the cooling tool is able to cool down the blank sufficiently rapidly, the cooling tool is "closed" before the press tool is closed, due to the biasing elements that force the upper and lower cooling dies in contact with the blank. Thus the dies of the cooling tool may be in contact enough time in order to properly cool down the blank.

With the integration of the tools in the same press, the transfer time from the cooling tool to the drawing/pressing tool may be reduced, thus the process may be optimized and the productivity may be improved while maintaining a satisfactory formability without causing a crack or the like at the blank.

The dies of the cooling tool incorporate some form of cooling means, in some examples, these can be cooling channels conducting cooling water. In some examples, the dies of the cooling tool may additionally comprise one or more heaters or channels conducting a hot liquid. This may allow working with blanks of different thicknesses i.e. including even very thin blanks which may be cooled down too fast, thus the flexibility of the cooling tool may be improved In a second aspect, a method for cooling down a blank may be provided. The method comprises: providing a press system according to the first aspect. The method further includes providing a blank to be hot formed made of an Ultra High Strength Steel (UHSS) having a Zinc coating. The blank may be heated. The press upper body is located at an open position using the press mechanism. Then, the blank is placed between the cooling tool upper and lower mating dies. The blank is pressed and cooled down by providing a downwards press progression of the mobile upper body with respect the fixed lower body so that the upper die is moved towards the lower die until a final desired position with respect to the fixed lower body for pressing the blank by deforming the biasing elements is reached.

In some examples, the blank comprises approximately 0.22% C, 1.2% Si, 2.2% Mn. This steel composition may provide for a blank to be passively hardened by ambient air from the temperature of the blank until a room temperature is reached, thus reducing the final press time.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
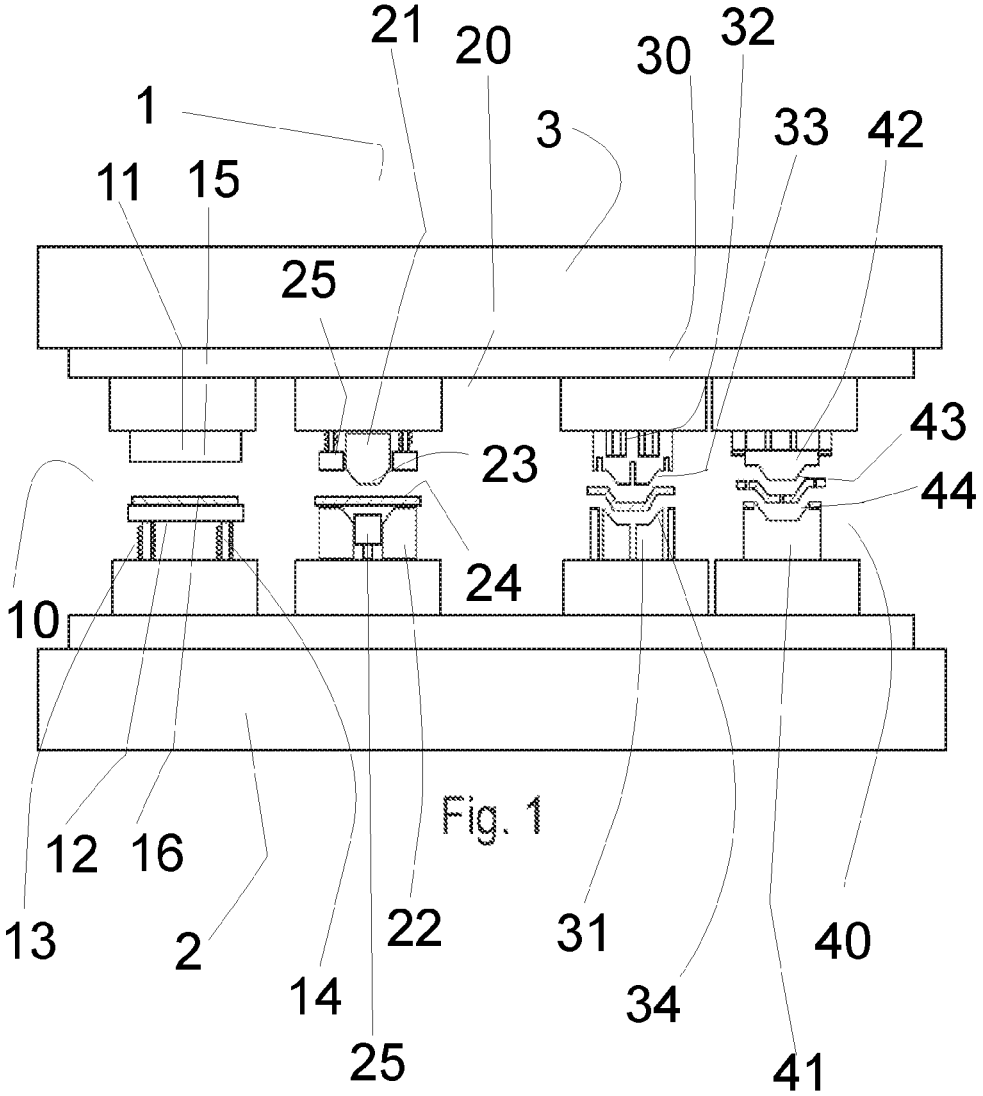
FIG. 1 schematically represents a multistep press system according to an example.

FIG. 1 schematically represents a multistep press system according to an example. The system 1 comprises a fixed lower body 2, a mobile upper body 3 and a mechanism (not shown) configured to provide upwards and downwards press progression of the mobile upper body 3 with respect to the fixed lower body 2.

The fixed lower body 2 may be a large block of metal. In this particular example, the fixed lower body 2 may be stationary. In some examples, a die cushion (not shown) integrated in fixed lower body 2 may be provided. The cushion may be configured to receive and control blank holder forces. The mobile upper body 3 may also be a solid piece of metal. The mobile upper body 3 may provide the stroke cycle (up and down movement).

The press system may be configured to perform approximately 30 strokes per minute, thus each stroke cycle may be of approximately 2 seconds. The stroke cycle could be different in further examples.

The mechanism of the press may be driven mechanically, hydraulically or servo mechanically. The progression of the mobile upper body 3 with respect to the fixed lower body 2 may be determined by the mechanism. In this particular example, the press may be a servo mechanical press, thus a constant press force during the stroke may be provided. The servo mechanical press may be provided with infinite slide (ram) speed and position control. The servo mechanical press may also be provided with a good range of availability of press forces at any slide position, thus a great flexibility of the press may be achieved. Servo drive presses may have capabilities to improve process conditions and productivity in metal forming. The press may have a press force of e.g. 2000 T.

In some examples, the press may be a mechanical press, thus the press force progression towards the fixed lower body 2 may depend on the drive and hinge system. Mechanical presses therefore can reach higher cycles per unit of time. Alternatively, hydraulic presses may also be used.

A cooling tool 10 configured to cool down a previously heated blank is shown in FIG. 1. The cooling tool 10 may comprise upper 11 and lower 12 mating dies. Each die may comprise an upper working surface 15 and a lower working surface 16 that in use face a blank (not shown) to be hot formed.

The lower die 12 may be connected to the lower body 2 with a first lower biasing element 13 and a second lower biasing element 14 configured to bias the lower die 12 to a position at a predetermined first distance from the lower body 2. In some examples, a single lower biasing element may be provided, or more than two lower biasing elements can be provided. The biasing elements may comprise, for example, a spring e.g. a mechanical spring or a gas spring although some other biasing elements may be possible e.g. hydraulic mechanism.

In some other examples that are not shown, the upper die 11 may also be connected to the upper body 3 with one or more upper biasing elements configured to bias the upper die in a position at a predetermined second distance from the upper body.

With the insertion of the upper and/or lower biasing elements, the contact time between the upper die 11 and the lower die 12 may be regulated and increased during a stroke cycle (up and down movement of the mobile upper body 3 with respect to the lower body 2).

Due to the biasing elements in the cooling tool, the contact between the upper and lower cooling dies may be produced before the contact of the press dies of the forming tool (and further tools arranged downstream). Thus, contact time between the cooling dies during a stroke cycle may be increased allowing for more cooling.

The upper 11 and lower 12 mating dies may comprise channels (not shown) with cold fluid e.g. water and/or cold compressed air passing through the channels provided in the dies.

Additionally, the cooling tool 10 may comprise one or more electrical heaters or channels conducting a hot liquid and temperature sensors to control the temperature of the dies. Other alternatives for adapting the dies to operate at higher temperatures may also be foreseen, e.g. embedded cartridge heaters. This may allow working with blanks of different thicknesses i.e. very thin blanks which may be cooled down too fast, thus the flexibility of the cooling tool may be improved. The sensors may be thermocouples.

Furthermore, the upper 11 and/or lower 12 mating dies may be provided with a cooling plate (not shown) which may be located at the surfaces opposite to the upper working surface 15 and/or the lower working surface 16 comprising a cooling system arranged in correspondence with each die respectively. The cooling system may comprise cooling channels for circulation of cold water or any other cooling fluid in order in order to avoid or at least reduce heating of the cooling tool or to provide an extra cooling to the cooling tool.

In examples, the cooling tool may be provided with centering elements e.g. pins and/or guiding devices.

A press tool 20 configured to form or draw the blank is also provided in this example. The press tool 20 is arranged downstream from the cooling tool 10. The press tool 20 comprises upper 21 and lower 22 mating dies.

The upper die 21 may comprise an upper working surface 23 that in use faces the blank to be hot formed. The lower die 22 may comprise a lower working surface 24 that in use faces the blank to be hot formed. A side of the upper die opposite to the upper working surface 23 may be fastened to the upper body 3 and a side of the lower die opposite to the lower working surface 22 may be fastened to the lower body 2.

The upper 21 and lower 22 mating dies may comprise channels with cold fluid e.g. water and/or cold air passing through the channels provided in the dies. In the water channels, the speed circulation of the water at the channels may be high, thus the water evaporation may be avoided. A control system may be further provided, thus the temperature of the dies may be controlled.

In examples, the press system 20 may be provided with a blank holder (25 configured to hold a blank and to positioning the blank onto the lower die 22. The blank holder may also be provided with a one or more biasing elements configured to bias the blank holder to a position at a predetermined distance from the lower die 22.

A first post-operation tool 30 configured to perform trimming and/or piercing operations may be provided. The first post-operation tool 30 may be arranged downstream of the press tool 20. The first post operation tool 30 may comprise upper 32 and lower 31 mating dies. The upper mating die 32 may comprise an upper working surface 33 and the lower mating die 31 may comprise a lower working surface 34. Both working surfaces in use face the blank.

A side of the upper die 32 opposite to the upper working surface 33 may be fastened to the upper body 3 and a side of the lower die 31 opposite to the lower working surface 34 may be fastened to the lower body 2. The dies may comprise one or more knives or cutting blades (not shown) arranged on the working surfaces.

The first post operation tool 30 may comprise one or more electrical heaters or channels conducting hot liquid and temperature sensors to control the temperature of the dies. The sensors may be thermocouples. In some examples, it is preferable to maintain the temperature of the blank located between the upper and lower dies when in use at or near a predetermined temperature e.g. above 200° C.

At or near 200° C. the strength of the blanks with a Zinc coating comprising 0.22% C, 1.2% Si, 2.2% and further elements may be around 800 MPa which may be the limit in order to avoid damage at the blades. This way, keeping the temperature above 200° C. may avoid damage at the cutting blades. The control may be an on-off control although some other controls in order to maintain the temperature may also be implemented.

In some examples, the upper 32 and lower 31 mating dies may comprise channels with cold fluid e.g. water and/or cold air passing through the channels provided in the dies.

In examples, the first post operation tool 30 may be provided with a blank holder (not shown) configured to hold a blank and to positioning the blank onto the lower die 31. The blank holder may also be provided with one or more biasing elements configured to bias the blank holder to a position at a predetermined distance from the lower die.

A second post-operation tool 40 may be provided. The second post-operation tool 40 may also be configured to perform further trimming and/or piercing operations. The second post-operation tool 40 may be arranged downstream of the first post operation tool 30. The second post-operation tool 40 may comprise an upper mating die 42 and a lower mating die 41. The upper mating die 42 may comprise an upper working surface 43 and the lower mating die 41 may comprise a lower working surface 44. Both working surfaces in use may face the blank to be hot formed. The working surfaces may be uneven, e.g. they may comprise protruding portions or recesses.

The dies at the press tool 40 may have a different temperature than the blank to be hot formed, thus the expansion may be taken into account. This way, the dies may be 2% higher than the blank to be hot formed in order to balance.

A side of the upper die 42 opposite to the working surface 43 may be fastened to the upper body 3. A side of the lower die 41 opposite to the working surface 44 is fastened to the lower body 2.

The dies may comprise one or more knives or cutting blades arranged on the working surfaces.

In some examples, an adjusting device (not shown) configured to adjust the distance between the upper 42 and lower 41 dies may be provided. This way, the blank located between the upper 42 and lower 41 dies when in use may be deformed along the working surfaces of each upper and lower die.

Once the adjustment of the distance between the upper 42 and lower dies 41 in order to deform (and thus calibrate the blank) is performed, the tolerances of the hot formed blank may be improved. In some examples, the blank to be hot formed may have an area with a non-optimized thickness e.g. greater thickness in one part of the blank than in some other part, thus the thickness has to be optimized.

With this arrangement of uneven working surfaces, the distance at selected portions of the working surfaces (e.g. near a radius in the blank) may be adjusted at or near the area with a non-optimized thickness, thus the material may be deformed i.e. forced to flow to zones adjacent to the area with a non-optimized thickness, thus a constant thickness along the blank may be achieved.

In examples, the adjusting device may be controlled based on a sensor system configured to detect the thickness of the blank.

In some examples, the second post-operation tool 40 may be provided with a blank holder (not shown) configured to hold a blank and to positioning the blank onto the lower die 41. The blank holder may also be provided with a one or more biasing elements configured to bias the blank holder to a position at a predetermined distance from the lower die.

In further examples, other ways of adapting the dies of the tools to operate at lower or higher temperatures may also be foreseen.

It should be understood that although the figures describe dies having a substantially square or rectangular shape, the blocks may have any other shape and may even have partially rounded shapes.

An automatic transfer device (not shown) e.g. a plurality of industrial robots or a conveyor may also be provided to perform the transfer of blanks between the tools.

In all examples, temperature sensors and control systems in order to control the temperature may be provided in any tools or in the transfer system. The tools may also be provided with further cooling systems, blanks holders, etc. . . .

FIGS. 2*a*-2*d* schematically illustrate a sequence of situations occurring during the performance of a method for cooling down a blank according to an example. Same reference numbers denote the same elements. The method is described below with reference to the sequences of situations illustrated by FIGS. 2*a*-2*d*.

Figure 2A:
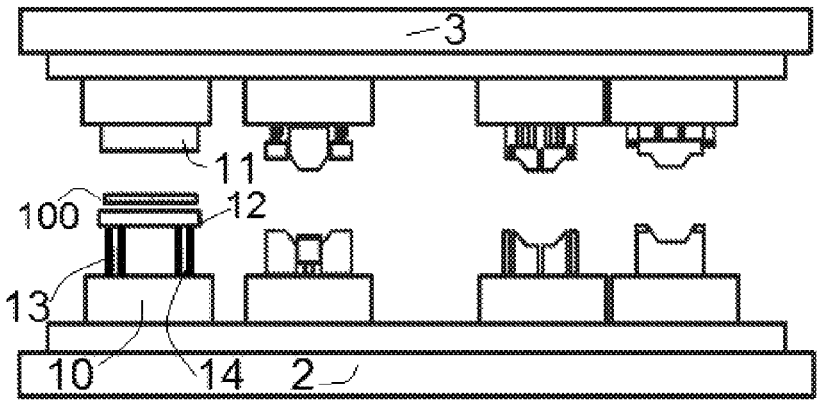
FIGS. 2*a*-2*d* schematically illustrate a sequence of situations occurring during the performance of a method for cooling down a blank according to an example.

For the sake of simplicity, references to angles have occasionally been included in descriptions relating to FIG. 2*a* (and further figures). The references to angles may be used to indicate approximate positions of the upper body with respect to the lower body.

Thus, for example, reference may be made to that the upper body is at 0° position with respect to the lower body which indicates that the upper body is in the highest position with respect to the lower body and 180° to indicate that the upper body is in the lowest position (full contact position) with respect to the lower body. 360° then refers again to the upper body being in the highest position.

In FIG. 2*a*, a blank 100 to be hot formed made of an Ultra High Strength Steel (UHSS) having a Zinc coating may be provided. In some examples, the UHSS may contain e.g. approximately 0.22% C, 1.2% Si, 2.2%. The amount of Si and Mn may enable to harden the blank at a room temperature, thus quenching may be avoided (and thus the blank manufacturing press time may be reduced). Moreover, the press stroke cycle may also be reduced since the dies of the extra cooling down for quenching stage do not remain closed during the cooling. The material may further comprise Mn, Al, Ti, B, P, S, N in different proportions.

The inventors have found that such Ultra High Strength Steel (UHSS) having a Zinc coating may have an Ac3 transformation point (austenite transformation point, hereinafter, referred to as "Ac3 point") between 860 and 870° C., e.g. for the above mentioned steel composition Ac3 may be approximately 867° C. The Ms transformation point (martensite start temperature, hereinafter, referred to as "Ms point") may be between 380 and 390° C. For the above mentioned steel composition, Ms may be approximately 386° C. The Mf transformation point (martensite finish temperature, hereinafter, referred to as "Mf point") may be at or near 270° C.

Different steel compositions may be used. Particularly the steel compositions described in EP 2 735 620 A1 may be considered suitable. Specific reference may be had to table 1 and paragraphs 0016-0021 of EP 2 735 620, and to the considerations of paragraphs 0067-0079.

The blank 100 may be heated in order to reach at least the austenization temperature. The heating may be performed in a heating device (not shown) e.g. a furnace. In this particular example, the maximum temperature to heat the blank may be determined by the coating. The melting point (and thus the evaporation temperature) of the Zinc may be at or near 910° C., thus the maximum temperature to heat the blank 100 in the heating device may be set below approximately 910° C. This way, the blank 100 may be heated to a temperature higher than Ac3 but lower than the evaporation temperature of the Zinc at or near 910° C. Thus, the heating may be performed between 867° C. and 910° C., preferably at or near 890° C. The period of time to be heated may be approximately 6 minutes, but it is dependent on e.g. the blank's thickness.

Once the blank 100 is heated to the desired temperature which is not shown in this figure, the blank 100 may be transferred to the cooling tool 10. This may be performed by an automatic transfer device (not shown) e.g. a plurality of industrial robots or a conveyor. The period of time to transfer the blank between the furnace (not shown) and the cooling tool 10 may be between 2 and 3 seconds.

In some examples, a centering element e.g. pins and/or guiding devices may be provided upstream the cooling tool, thus the blank may be properly centered.

The press upper body 3 may be located at an open position (0° position) using the press mechanism. The blank 100 may be placed between the upper die 11 and the lower die 12. In some examples, the blank may be placed on a blank holder. The lower die 12 may be displaced at a predetermined distance with respect the lower body 2 using a first lower biasing element 13 and a second lower biasing element 14.

As commented above, the biasing elements may comprise, for example, a spring e.g. a mechanical spring or a gas spring although some other biasing elements may be possible e.g. hydraulic mechanism. The hydraulic mechanism may be a passive or an active mechanism This way, the lower die 12 (and thus the blank 100 located on the lower die 12) may be situated at a first predetermined position (a position where the lower die may be contacted between 90° and 150° by the upper die) from the lower body 2.

Figure 2B:
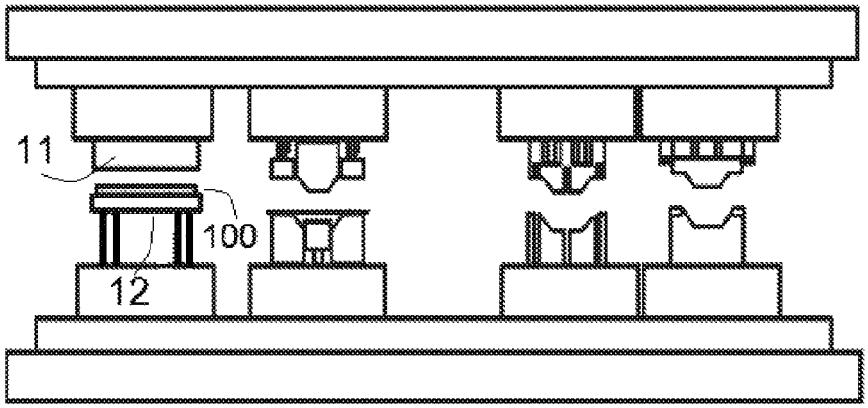

In FIG. 2*b*, the press may be provided with a downwards press progression of the mobile upper body with respect to the fixed lower body, thus the upper die 11 may be moved towards the lower die 12 (and thus the blank located on the lower die).

The upper die 11 may contact the blank 100 placed between the cooling tool upper die 11 and the cooling tool lower die 12 at the first predetermined position (between 90° and 150° position).

Figure 2C:
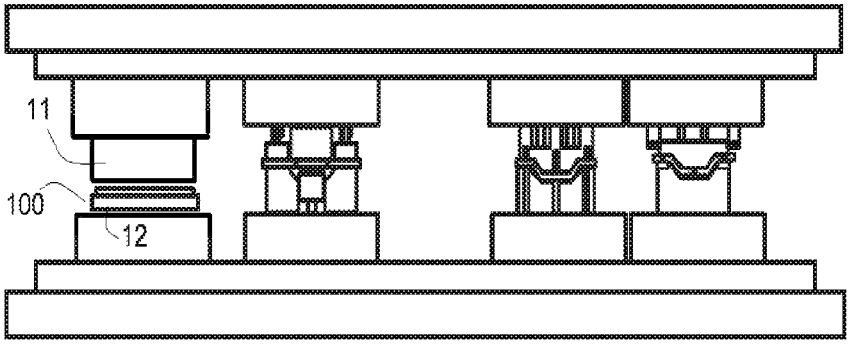

In FIG. 2*c*, once the blank is contacted between 90° and 150°, the upper die 11 may start to cool down the blank 100. By pressing the blank, the first lower biasing element and the second lower biasing element may be deformed until a final desired position (180° position) to press and cool down the blank 100 is reached.

Figure 2D:
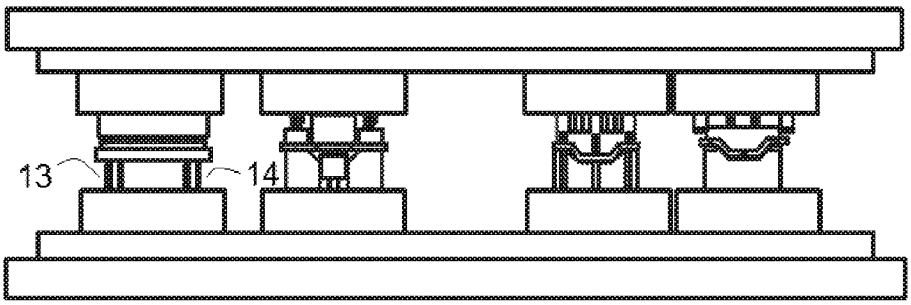

In FIG. 2*d*, once the final desired position (180° position) is reached, an upwards press progression of the upper body by the press mechanism may be provided. The last contact between the upper die and the blank may be between 210° and 270° position of the upper body (and thus the upper die) with respect to the lower body. The first lower biasing element 13 and the second lower biasing element 14 may return to their original position i.e. be extended. This way, the period of time since the blank 100 is contacted for the first time by upper die and the last contact i.e. the time that the blank is cooled down may be between 0.33 and 1 second.

As previously commented, while the blank 100 is pressed, the blank may be cooled down by using cooling equipment. It has been found that the Ultra High Strength Steel (UHSS) having a Zinc coating may show microcraks for temperatures higher than 600° C. at a press tool. This way, the blank may be cooled down before being transported to the press tool to temperatures below 600° C., preferably at or near 550° C., thus the microcracks may be reduced.

It has already been commented that the blank 100 may be previously heated at or near 890° C. i.e. heated at a furnace. The blank may be transferred to the cooling tool 10, thus the during the transfer period the temperature may be reduced between 750° C. and 850° C. With this arrangement, the blank 100 may be placed at the cooling tool 10 between 750° C. and 850° C. The blank may then be cooled down to a temperature at or near 570° C. This may lead to a cool down rate between 200 and 800° C./s, in some examples at or near 500° C./s.

With the cooling tool 10 integrated in the press system 3, the time in order to cool down the blank may be optimized since an extra movement in order to transfer the blank from an external cooling tool may be avoided. It also may be time saving. Furthermore, the movements of the blank between the tools may be limited, thus the cooling rates are easily controlled.

FIGS. 2*e*-2*h* schematically illustrate a sequence of situations occurring during the performance of a method for drawing a blank according to an example. Same reference numbers denote the same elements. The method is described below with reference to the sequences of situations illustrated by FIGS. 2*e*-2*h*.

Figure 2E:
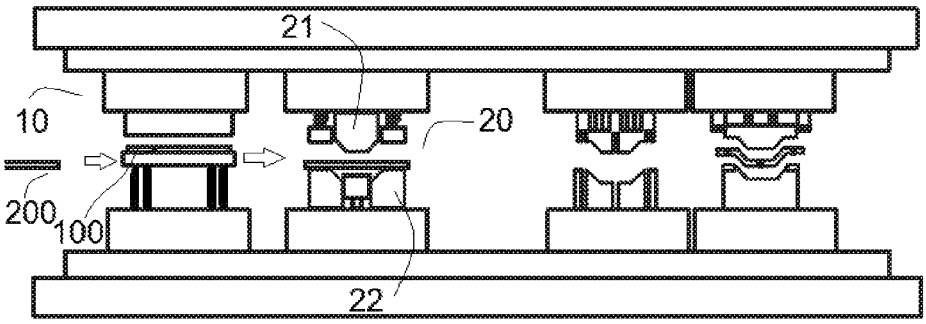
FIGS. 2*e*-2*h* schematically illustrate a sequence of situations occurring during the performance of a method for drawing the same blank according to an example.

In FIG. 2*e*, the blank 100 may already be cooled down, thus the blank 100 may be ready to be transferred from the cooling tool 10 to the press tool 20. The transferring may be performed by an automatic transfer device (not shown) e.g. a plurality of industrial robots or a conveyor. As commented above, the blank may transferred at a temperature at or near 570° C. Due to the transfer time, the blank 100 may be cooled down at or near 550° C. when it reaches the forming tool. The blank 100 may be positioned by the transfer device onto the lower die 22 using a blank holder. In some examples, the distance of the blank holder with respect to the press lower die 22 may be regulated using a one or more biasing elements.

Since the transfer device is integrated in the same press system, there is less transfer time, and the temperature control is better.

While the blank 100 is being transferred or positioned onto the lower die 22, the automatic transfer system may be operated to provide a blank 200 to the cooling tool 10. As a result, the cooling tool 10 may start the operation in order to cool down the blank. This operation may be performed as stated before. Furthermore, this operation may be performed at the same time as the operation of the press tool 20.

This way, the press upper body 3 may be located again at an open position (0° position) using the press mechanism. The blank 100 may be placed between the press tool upper die 21 and the press tool lower die 22.

Figure 2F:
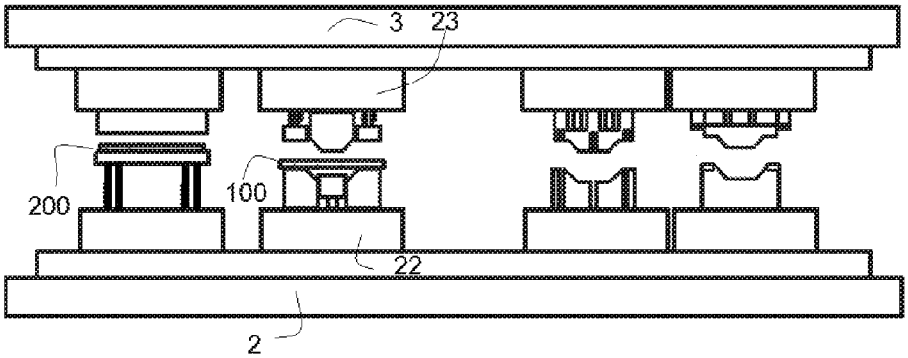

In FIG. 2*f*, the press 1 may be provided with a downwards press progression of the mobile upper body 3 with respect to the fixed lower body 2, thus the upper die 21 may be moved towards the lower die 22.

Figure 2G:
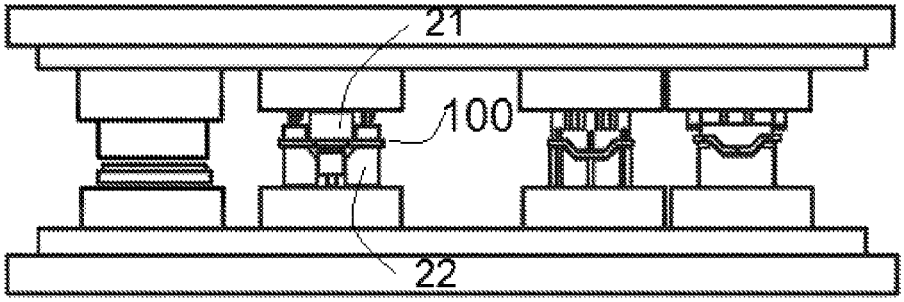

In FIG. 2*g*, the upper die 21 may contact the blank 100 placed between the press tool upper die 21 and the press tool lower die 22 approximately at 180° position. Once the blank is contacted, the upper die 21 may start to press and draw the blank 100.

Figure 2H:
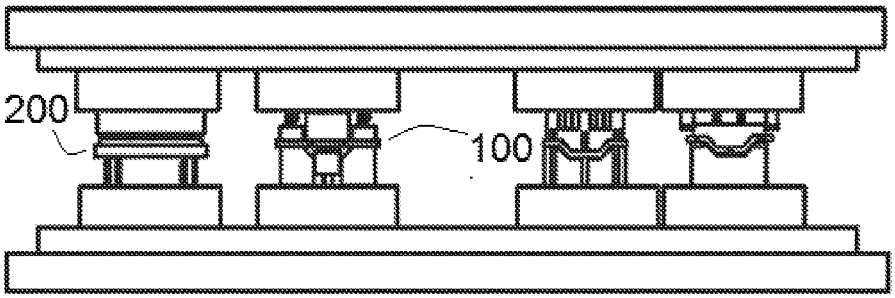

In FIG. 2*h*, once the final desired position is reached, an upwards press progression may be provided. The last complete contact between the working surface of the upper die of the forming tool and the blank (and thus the end of the drawing operation) may be between 180° and 210° position. The last contact between the blank and blank holder may be between for example 210°-270°.

The temperature of the blank 100 may be reduced until a temperature at or near 300° C. is reached. The press tool may be provided with a cooling system. The cooling system may be controlled by a controller, thus the temperature of the blank 100 may be reduced and maintained at a desired temperature.

At the same time, the blank 200 may be pressed and cooled down using the cooling system 10. The operation of the cooling tool 10 with the blank 200 may be the same as stated above.

Figure 2I:
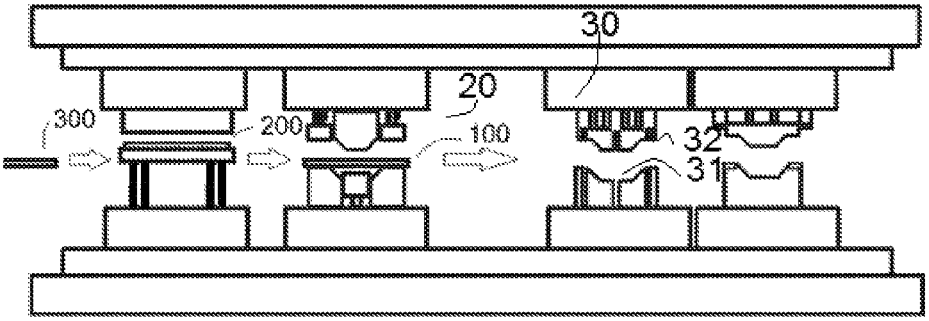
FIGS. 2*i*-2*l* schematically illustrate a sequence of situations occurring during the performance of a method for piercing and/or trimming the same blank according to an example.

FIGS. 2*i*-2$_l$ schematically illustrate a sequence of situations occurring during the performance of a method for piercing and/or trimming the same blank according to an example. Same reference numbers denote the same elements. The method is described below with reference to the sequences of situations illustrated by FIGS. 2*i*-2*l*.

In FIG. 2*i*, the blank 100 has been drawn, thus the blank 100 may be ready to be transferred from the press tool 20 to the first post operation tool 30 e.g. piercing or trimming operations tool. The transferring may be performed by an automatic transfer device (not shown) e.g. a plurality of industrial robots or a conveyor. As commented above, the blank 100 may leave the press tool 20 and it may be transferred at a temperature at or near 300° C. Due to the transfer time, the blank 100 may be cooled down at or near 280° C., thus placed at the first post operation tool at this temperature. The blank 100 may be placed onto the lower die 31 and between the lower die 31 and the upper die 32.

Figure 2J:
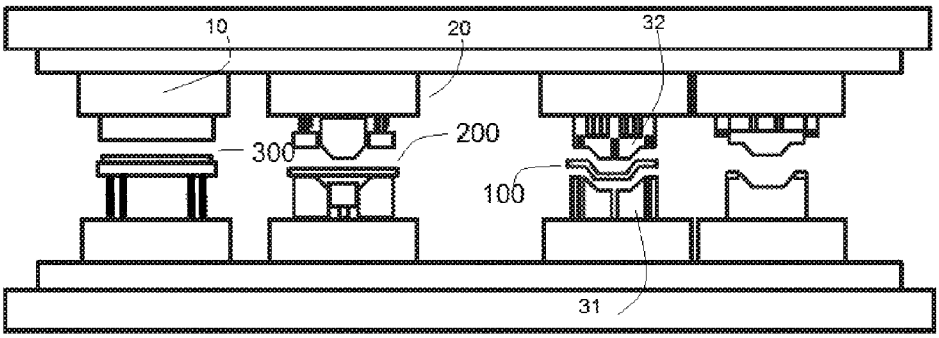

In FIG. 2*j*, when the blank 100 has been transferred or positioned onto the lower die 31, the automatic transfer system may be operated to provide the blank 200 to the press tool 20 and to provide a blank 300 to the cooling tool 10. As a result, the cooling tool 10 may start the operation in order to press and cool down the blank 300 as commented above. At the same time, the press tool 20 may start the operation in order to draw and cool down the blank 300 as also commented above.

This way, the press upper body 32 may be located at an open position (0° position) using the press mechanism. The press 1 may be provided with a downwards press progression of the mobile upper body 3 with respect to the fixed lower body 2, thus the upper die 32 may be moved towards the lower die 31.

Figure 2K:
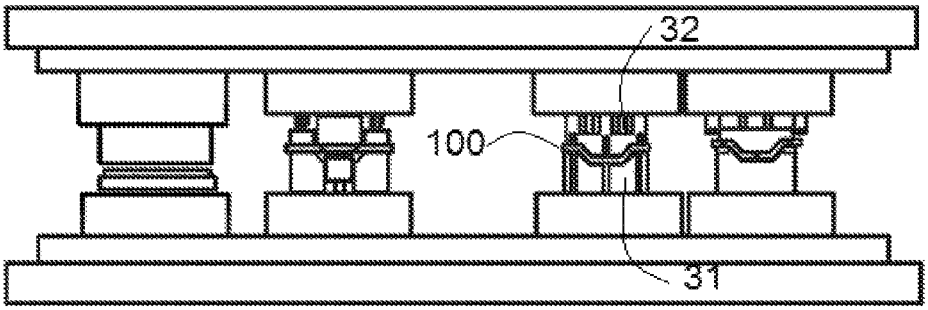

In FIG. 2*k*, the upper die 32 may contact the blank 100 placed between the press tool upper die 31 and the press tool lower die 31 until the final desired position (at or near 180°) is reached.

While the press is in contact with the blank 100, a piercing operation may be performed using the cutting blades or some other cutting element. Once the piercing operation is finished, a trimming operation may be performed. In alternative examples, the trimming operation may be performed first and the trimming operation may be performed once the trimming operation is finished.

While the blank 100 undergoes the post operation, the blank may be heated up by using the heating equipment commented above. It has been found that the Ultra High Strength Steel (UHSS) having a Zinc coating at or near 200° C. may have strength at or near 800 MPa. This may be the maximum strength possible in order to perform the operation e.g. trimming and/or piercing operations. This way, a heating system with a control temperature system may be provided, thus the temperature of the blank 100 may be maintained above 200° C. With this arrangement, the strength of the blank may be maintained at reasonable values in order to be pierced and/or trimmed.

Figure 2L:
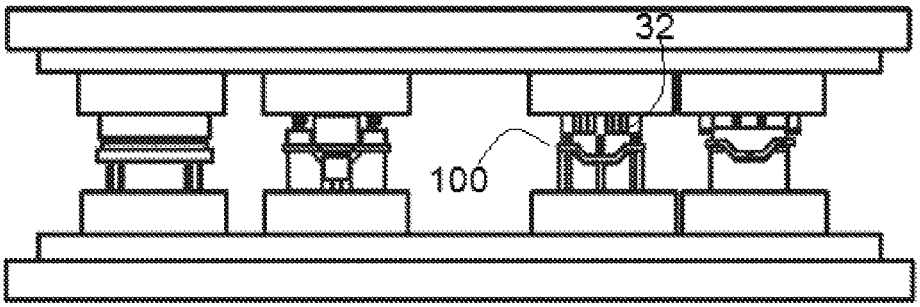

In FIG. 2*l*, once the final desired position (180° position) is reached, an upwards press progression may be provided. The last complete contact between the working surface of the upper die 32 and the blank 100 (and thus the end of the operation) may be between 180° and 210° position. The last contact between blank and blank holder may occur between 210° and 270°.

FIGS. 2*m*-2*p* schematically illustrate a sequence of situations occurring during the performance of a method for further piercing and/or trimming a blank according to an example. Same reference numbers denote the same elements. The method is described below with reference to the sequences of situations illustrated by FIGS. 2*m*-2*p*.

Figure 2M:
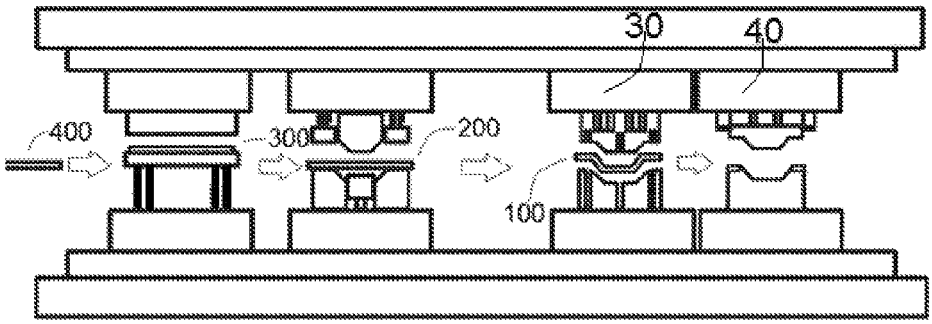
FIGS. 2*m*-2*p* schematically illustrate a sequence of situations occurring during the performance of a method for further piercing and/or trimming the same blank according to an example.

In FIG. 2*m*, the blank 100 may be transferred from the first post-operation tool 30 to the second post-operation tool 40 e.g. piercing, trimming and calibration tool. The transferring may be performed by an automatic transfer device (not shown) e.g. a plurality of industrial robots or a conveyor. As previously commented, the blank 100 may leave the first post-operation tool 30 and it may be transferred at a temperature at or near 200° C.

Figure 2N:
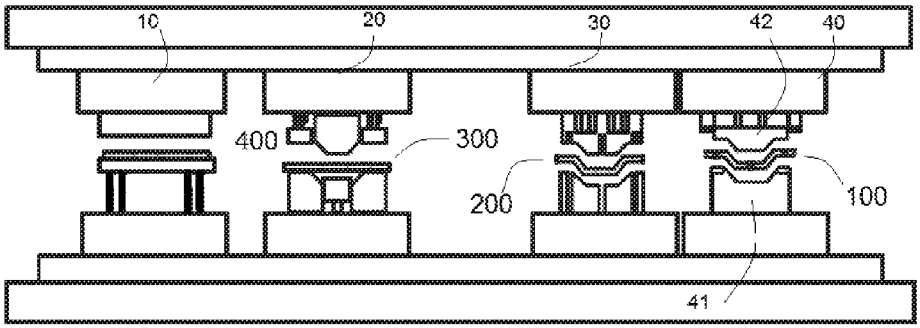

In FIG. 2*n*, the blank 100 may be placed onto the lower die 41, for example using a blank holder. The blank may be located between the lower die 41 and the upper die 42.

While the blank 100 is being transferred or positioned onto the lower die 41, the automatic transfer system may be operated to provide the blank 200 to the first post-operation tool 30, the blank 300 to the press tool 20 and a blank 400 to the cooling tool 10. As a result, the cooling tool 10 may start the operation in order to press and cool down the blank 400. At the same time, the press tool 20 and the first post-operation tool 30 may start their operation respectively. The tool's operation may be the same as previously commented.

Figure 2O:
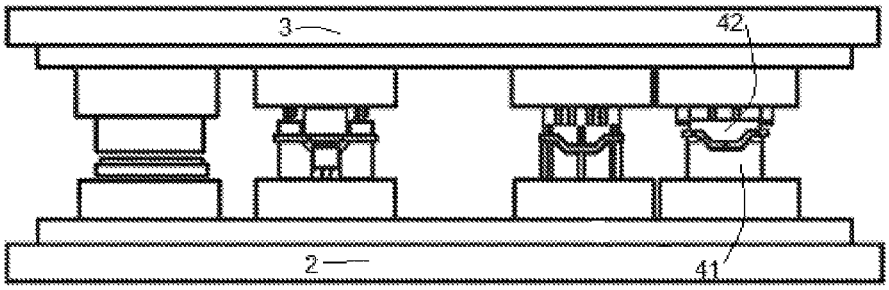

In FIG. 2*o*, the press upper body 42 may be located at an open position (0° position) using the press mechanism. The press 1 may be provided with a downwards press progression of the mobile upper body 3 with respect to the fixed lower body 2, thus the upper die 42 may be moved towards the lower die 41. The upper die 42 may contact the blank placed between the upper die 41 and lower die 42 at the final desired position (at or near 180° of the upper die with respect of the lower body).

While the press is in contact with the blank 100, piercing operation may be performed using the cutting blades. Once the piercing operation is finished, a trimming operation may be performed. In alternative examples, the trimming operation may be performed first and the trimming operation may be performed once the trimming operation is finished.

Additionally, a calibration operation may be performed, thus the tolerance of the blank may be improved. This way, the distance between the upper die 42 and the lower die 41 may be adjusted using an adjusting device. The adjusting device may be controlled based on a sensor system (not shown) configured to detect the thickness of the blank 100. Following the example, the blank may be pressed by the upper 42 and lower 41 dies, thus a constant thickness of the blank may be achieved.

Once the operation of the second post-operation tool is finished, the blank 100 may be transferred and hardened at a room temperature.

Figure 2P:
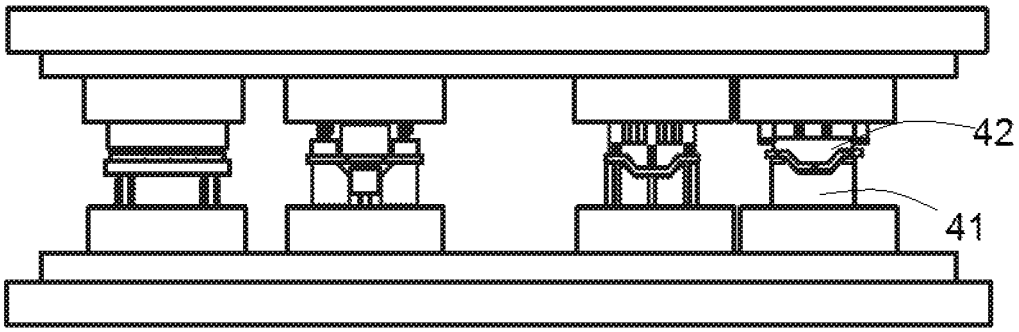

In FIG. 2*p*, once the final desired position (180° position) is reached, an upwards press progression may be provided. The last complete contact between the working surface of upper die 42 and the blank 100 (and thus the end of the second operation) may be between 180° and 210° position. The last contact between blank and blank holder may occur between 210° and 270°.

Once the open position (0° position) is reached by the press by applying the upwards movement, the blank 100 may be transferred and hardened at a room temperature. At the same time, the automatic transfer system may be operated to provide a blank 500 to the cooling tool 10, the blank 200 to the second post-operation tool 40, the blank 300 to the first post-operation tool 30 and the blank 400 to the press tool 20. As a result, all the tools may start their operations as previously commented.

In some examples, depending on the shape of the blank 100, further drawing and other operations e.g. piercing and/or trimming may be provided. In further examples, the order of post-operations may be interchanged (e.g. first cutting, then calibrating or vice versa).

For reasons of completeness, various aspects of the present disclosure are set out in the following numbered clauses:

Clause 1. A press system for manufacturing hot formed structural components, the system comprising a fixed lower body, a mobile upper body and a mechanism configured to provide upwards and downwards press progression of the mobile upper body with respect to the fixed lower body, the system comprising:

- a cooling tool configured to cool down a previously heated blank, the cooling tool comprising:
  - upper and lower mating cooling dies, each cooling die comprising one or more working surfaces that in use face the blank, and
  - the lower cooling die is connected to the lower body with one or more lower biasing elements configured to bias the lower cooling die towards a position at a predetermined first distance from the lower body and/or the upper cooling die is connected to the upper body with one or more upper biasing elements configured to bias the upper cooling die towards a position at a predetermined second distance from the upper body,
- a press tool configured to draw the blank, wherein the press tool is arranged downstream from the cooling tool and comprises:
  - upper and lower mating pressing dies, each pressing die comprising one or more working surfaces that in use face the blank, and
  - the upper pressing die is fastened to the upper body and the lower pressing die is fastened to the lower body, and
- a blank transfer mechanism to transfer the blank from the cooling tool to the press tool.

Clause 2. A system according to clause 1, further comprising a first post-operation tool configured to perform trimming and/or piercing operations, wherein the first post-operation tool is arranged downstream of the press tool and comprises:

- upper and lower mating first post-operation tool dies, each die comprising one or more working surfaces that in use face the blank and,
- the upper first post-operation tool die is fastened to the upper body and the lower first post-operation tool die is fastened to the lower body, and
- the dies comprising one or more cutting blades arranged on the working surfaces, and
- the blank transfer mechanism is further configured to transfer the blank from the press tool to the first post-operation tool.

Clause 3. A system according to clause 2, further comprising a second post-operation tool configured to perform trimming and/or piercing operations, wherein the second post-operation tool is arranged downstream of the first post-operation tool and comprises:

- upper and lower mating second post operation tool dies, each die comprising one or more working surfaces that in use face the blank and,
- the upper second post operation tool die is fastened to the upper body and the lower second post operation tool die is fastened to the lower body, and
- the dies comprising one or more cutting blades arranged on the working surfaces, and
- the blank transfer mechanism is further configured to transfer the blank from the first post-operation tool to the second post-operation tool.

Clause 4. A system according to clause 3, wherein the second post-operation tool comprises an adjusting device configured to adjust the distance between the upper and lower dies so as to deform the blank located in use at the second post-operation tool along the working surface of each upper and lower die, wherein the adjusting device is controlled based on a sensor system configured to detect the thickness of the blank.

Clause 5. A system according to claim any of clauses 1-4, wherein the dies of the first post-operation tool comprise one or more heaters or channels conducting a hot liquid.

Clause 6. A system according to clause 5, wherein the heaters or channels conducting a hot liquid are configured to maintain the temperature of the blank above 200° C. based on the temperature measured at the die.

Clause 7. A system according to claim any of clauses 1-6, wherein the dies of the cooling tool comprise one or more heaters or channels conducting a hot liquid.

Clause 8. A system according to any of clauses 1-7, wherein the dies of the cooling tool comprise channels conducting cooling water.

Clause 9. A system according to any of clauses 1-8, wherein the dies of the cooling tool comprise channels conducting air.

Clause 10. A system according to any of clauses 1-9, wherein the dies of the press tool comprise channels conducting cooling water and/or channels conducting air.

Clause 11. A system according to any of clauses 1-10, wherein the dies of the first post-operation tool comprise channels conducting cooling water.

Clause 12. A system according to any of clauses 1-11, wherein the dies of the first post-operation tool comprise channels conducting air.

Clause 13. A system according to any of clauses 1-12, wherein a temperature of the cooling dies and/or of the press dies and/or of the first post operation tool dies and/or of the second post operation tool dies is configured to be regulated based on a temperature measured at the dies.

Clause 14. A system according to clause 13, wherein the dies comprise one or more thermocouples configured to measure the temperature of the dies.

Clause 15. A method for cooling down a blank comprising:

Providing a press system according to any of clauses 1-14;

Providing a blank to be hot formed made of an Ultra High Strength Steel (UHSS) having a Zinc coating;

Heating the blank;

Locating the press upper body at an open position using the press mechanism;

Placing the blank between the cooling tool upper and lower mating dies;

Pressing and cooling down the blank by providing a downwards press progression of the mobile upper body with respect the fixed lower body so as the upper die is moved towards the lower die until a final desired position with respect to the fixed lower body for pressing the blank by deforming the biasing elements is reached.

Clause 16. A method according to clause 15, wherein the blank is heated to an austenization temperature between 860° C. and 910° C.

Clause 17. A method according to any of clauses 15-16, wherein the UHSS comprises approximately 0.22% C, 1.2% Si, 2.2% Mn.

Clause 18. A method according to clause 17, wherein the UHSS further comprises Mn, Al, Ti, B, P, S, N.

Clause 19. A method according to any of clauses 15-18, wherein the blank is cooled down to a temperature between 500 and 600° C.

Clause 20. A method according to any of clauses 15-19, wherein the blank is cooled down at a rate between 400 and 600° C./s.

Clause 21. A method for drawing a blank comprising a method according to any of clauses 15-20 further comprising:

Transferring the blank from the cooling tool to the press tool;

Placing the blank between the press tool upper and lower dies;

Drawing the blank by providing a forward press progression of the mobile upper body with respect the fixed lower body until a final desired position with respect to the press fixed lower body for pressing the structural component is reached.

Clause 22. A method according to clause 21, further comprising cooling down the blank during drawing.

Clause 23. A method according to clause 22, wherein the blank is cooled down to a temperature between 320° C. and 280° C.

Clause 24. A method for piercing and/or trimming a blank comprising a method according to any of claims 21-23 when dependent on clause 2 further comprising:

Transferring the blank from the press tool to the first post-operation tool;

Placing the structural component to be formed between the first post-operation tool upper and lower mating dies;

Providing a downwards press progression of the press mobile upper body with respect to the press fixed lower body until the final desired position with respect to the press fixed lower for pressing the blank is reached;

Cutting and/or punching the blank using the cutting blades of the first post-operation tool.

Clause 25. A method according to clause 24, wherein the temperature of the blank located at the first post-operation tool is maintained above 200° C.

Clause 26. A method for further piercing and/or trimming and calibrating a hot formed structural component to be formed comprising a method according to any of clauses 24-25 when dependent on clause 3 further comprising:

Transporting the structural component from the first post-operation tool to the second post-operation tool;

Providing a downward press progression of the press mobile upper body with respect to the press fixed lower body until the final desired position for pressing the structural component is reached;

Cutting and/or punching the structural component using the cutting blades;

Adjusting the distance between the upper and lower dies so as to deform the structural component to be formed along the working surface of each upper and lower die;

Clause 27. A hot formed structural component as obtainable by the method according to clause 26.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

We claim:

1. A press system for manufacturing hot formed structural components, the system comprising a fixed lower body, a mobile upper body and a mechanism configured to provide upwards and downwards press progression of the mobile upper body with respect to the fixed lower body, the system comprising:

a cooling tool configured to cool down a previously heated blank, the cooling tool comprising:

upper and lower mating cooling dies, each cooling die comprising one or more working surfaces that in use face the blank, and the lower cooling die is connected to the lower body with one or more lower biasing elements configured to bias the lower cooling die towards a position at a predetermined first distance from the lower body and/or the upper cooling die is connected to the upper body with one or more upper biasing elements configured to bias the upper cooling die towards a position at a predetermined second distance from the upper body, a press tool configured to draw the blank, wherein the press tool is arranged downstream from the cooling tool and comprises:

upper and lower mating pressing dies, each pressing die comprising one or more working surfaces that in use face the blank, and the upper pressing die is fastened to the upper body and the lower pressing die is fastened to the lower body, and a blank transfer mechanism to transfer the blank from the cooling tool to the press tool.

2. The system according to claim 1, further comprising a first post-operation tool configured to perform trimming and/or piercing operations, wherein the first post-operation tool is arranged downstream of the press tool and comprises:

upper and lower mating first post-operation tool dies, each die comprising one or more working surfaces that in use face the blank and, the upper first post-operation tool die is fastened to the upper body and the lower first post-operation tool die is fastened to the lower body, and the dies comprising one or more cutting blades arranged on the working surfaces, and the blank transfer mechanism is further configured to transfer the blank from the press tool to the first post-operation tool.

3. The system according to claim 2, further comprising a second post-operation tool configured to perform trimming and/or piercing operations, wherein the second post-operation tool is arranged downstream of the first post-operation tool and comprises:

upper and lower mating second post operation tool dies, each die comprising one or more working surfaces that in use face the blank and, the upper second post operation tool die is fastened to the upper body and the lower second post operation tool die is fastened to the lower body, and the dies comprising one or more cutting blades arranged on the working surfaces, and the blank transfer mechanism is further configured to transfer the blank from the first post-operation tool to the second post-operation tool.

4. The system according to claim 3, wherein the second post-operation tool comprises an adjusting device configured to adjust the distance between the upper and lower dies so as to deform the blank located in use at the second post-operation tool along the working surface of each upper and lower die, wherein the adjusting device is controlled based on a sensor system configured to detect a thickness of the blank.

5. The system according to claim 2, wherein the dies of the first post-operation tool comprise one or more heaters or channels conducting a hot liquid.

6. The system according to claim 3, wherein the dies of the first post-operation tool comprise one or more heaters or channels conducting a hot liquid.

7. The system according to claim 1, wherein the dies of the cooling tool comprise one or more heaters or channels conducting a hot liquid.

8. The system according to claim 2, wherein the dies of the cooling tool comprise one or more heaters or channels conducting a hot liquid.

9. The system according claim 1, wherein the dies of the cooling tool and/or the dies of the press tool comprise channels conducting cooling water and/or air.

10. The system according claim 2, wherein the dies of the cooling tool and/or the dies of the press tool comprise channels conducting cooling water and/or air.

11. The system according to claim 2, wherein the dies of the first post-operation tool comprise channels conducting cooling water and/or air.

12. The system according to claim 3, wherein the dies of the first post-operation tool comprise channels conducting cooling water and/or air.

13. The system according to claim 1, wherein a temperature of the cooling dies and/or of the press dies and/or of the first post operation tool dies and/or of the second post operation tool dies is configured to be regulated based on a temperature measured at the dies.

14. The system according to claim 2, wherein a temperature of the cooling dies and/or of the press dies and/or of the first post operation tool dies and/or of the second post operation tool dies is configured to be regulated based on a temperature measured at the dies.

15. A method for cooling down a blank, comprising:

Providing a press system according to claim 1;

Providing a blank to be hot formed made of an Ultra High Strength Steel (UHSS) having a Zinc coating;

Heating the blank;

Locating the press upper body at an open position using the press mechanism;

Placing the blank between the cooling tool upper and lower mating dies;

Using the upper and/or lower biasing elements, pressing and cooling down the blank by providing a downwards press progression of the mobile upper body with to respect the fixed lower body to deform the blank, wherein the upper die is moved towards the lower die until a final desired position of the mobile upper body with respect to the fixed lower body is reached.

16. The method according to claim 15, wherein the UHSS comprises approximately 0.22% C, 1.2% Si, and 2.2% Mn.

17. The method according to claim 15, further comprising:

Transferring the blank from the cooling tool to the press tool;

Placing the blank between the press tool upper and lower dies;

Drawing the blank by providing a forward press progression of the mobile upper body with respect the fixed lower body until a final desired position with respect to the press fixed lower body is reached.

18. The method according to claim 17, further comprising cooling down the blank during drawing.

19. The method according to claim 17, further comprising:

Providing a first post-operation tool configured to perform trimming and/or piercing operations, wherein the first post-operation tool is arranged downstream of the press tool and comprises:

upper and lower mating first post-operation tool dies, each die comprising one or more working surfaces that in use face the blank, the upper first post-operation tool die is fastened to the upper body and the lower first post-operation tool die is fastened to the lower body, and the dies comprising one or more cutting blades arranged on the working surfaces, and the blank transfer mechanism is further configured to transfer the blank from the press tool to the first post-operation tool;

Transferring the blank from the press tool to the first post-operation tool;

Placing the structural component to be formed between the upper and lower mating first post-operation tool dies;

Providing a downwards press progression of the mobile upper body with respect to the fixed lower body until the final desired position with respect to the fixed lower body is reached;

Cutting and/or punching the blank using the cutting blades of the first post-operation tool.

20. The method according to claim 19, further comprising:

Providing a second post-operation tool configured to perform trimming and/or piercing operations, wherein the second post-operation tool is arranged downstream of the first post-operation tool and comprises:

upper and lower mating second post operation tool dies, each die comprising one or more working surfaces that in use face the blank, the upper second post operation tool die is fastened to the upper body and the lower second post operation tool die is fastened to the lower body, the dies comprising one or more cutting blades arranged on the working surfaces, and the blank transfer mechanism is further configured to transfer the blank from the first post-operation tool to the second post-operation tool;

Transporting the structural component from the first post-operation tool to the second post-operation tool;

Providing a downward press progression of the mobile upper body with respect to the fixed lower body until the final desired position for pressing is reached;

Cutting and/or punching the structural component using the cutting blades;

Adjusting a distance between the upper and lower mating second post operation dies so as to deform the blank along the working surface of each upper and lower mating second post operation die.

* * * * *